United States Patent [19]

Hall

[11] 4,213,560

[45] Jul. 22, 1980

[54] ADJUSTABLE MAILBOX STANDARD

[76] Inventor: Robert E. Hall, 4187 Mogadore Rd., Kent, Ohio 44240

[21] Appl. No.: 924,944

[22] Filed: Jul. 17, 1978

[51] Int. Cl.[2] ..... A47G 29/12

[52] U.S. Cl. ..... 232/39; 248/122; 248/131; 248/156

[58] Field of Search ..... 232/38, 39; 248/121, 248/122, 131, 149, 156, 146

[56] References Cited

U.S. PATENT DOCUMENTS

| | | | |
|---|---|---|---|
| 759,437 | 5/1904 | Harward | 232/39 |
| 1,439,701 | 12/1922 | Haney | 248/121 |
| 1,533,887 | 4/1925 | Mugler | 248/149 |
| 2,200,690 | 5/1940 | Elliott | 248/156 |
| 2,409,326 | 10/1946 | Wargo | 248/146 |
| 2,562,021 | 7/1951 | Dotten | 248/156 X |
| 3,289,443 | 12/1966 | Norman | 248/121 X |
| 3,833,168 | 9/1974 | Sackrison | 232/39 |
| 4,113,213 | 9/1978 | Gay | 232/39 X |

FOREIGN PATENT DOCUMENTS

| | | | |
|---|---|---|---|
| 45717 | 9/1908 | Switzerland | 232/39 |

*Primary Examiner*—Roy D. Frazier
*Assistant Examiner*—Peter A. Aschenbrenner
*Attorney, Agent, or Firm*—Oldham, Oldham, Hudak & Weber

[57] ABSTRACT

A mailbox standard is presented which includes a hollow steel post, pointed at one end, for driving into the ground. A collar fits over the post and is adjustably secured thereto by means of a setscrew or the like. Extending upwardly and obliquely from the collar is a truss having an adjustable support bracket pivotally maintained at the end thereof. The support bracket is adapted for receiving various sizes of mailboxes in any of numerous positions of alignment with respect to the post itself. The invention also includes a collar maintained upon the truss for receiving a newspaper receptacle or the like.

5 Claims, 9 Drawing Figures

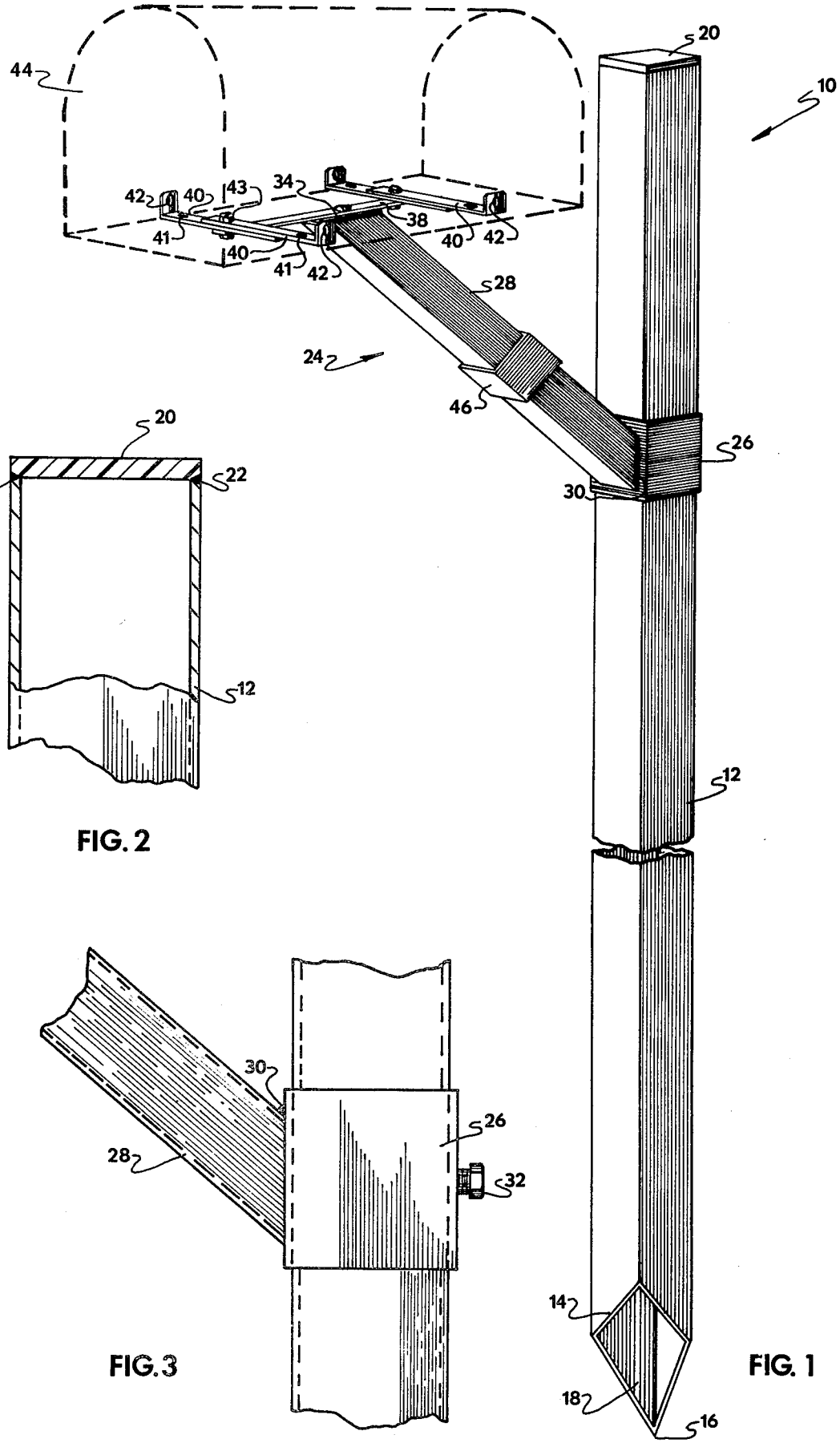
FIG. 1
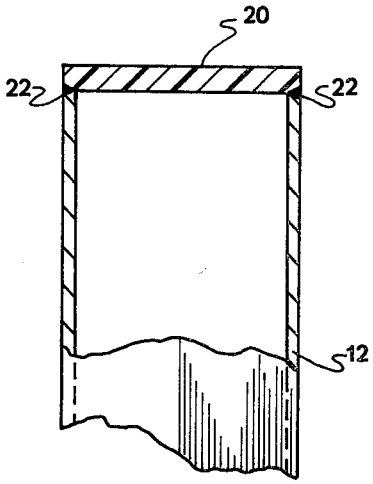
FIG. 2
FIG. 3

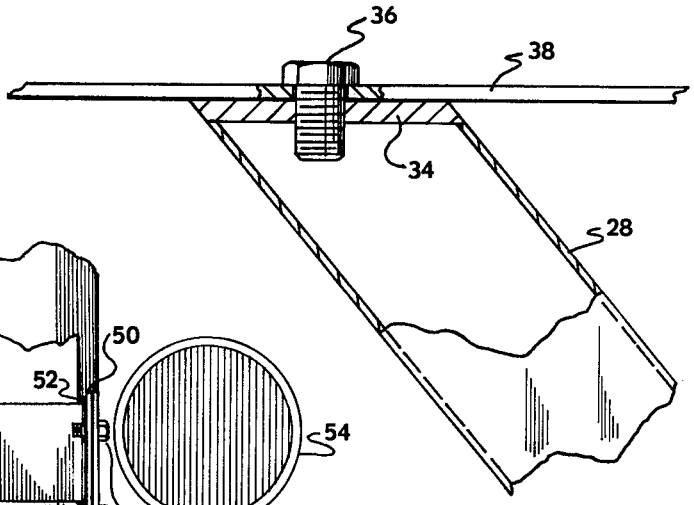
FIG. 4
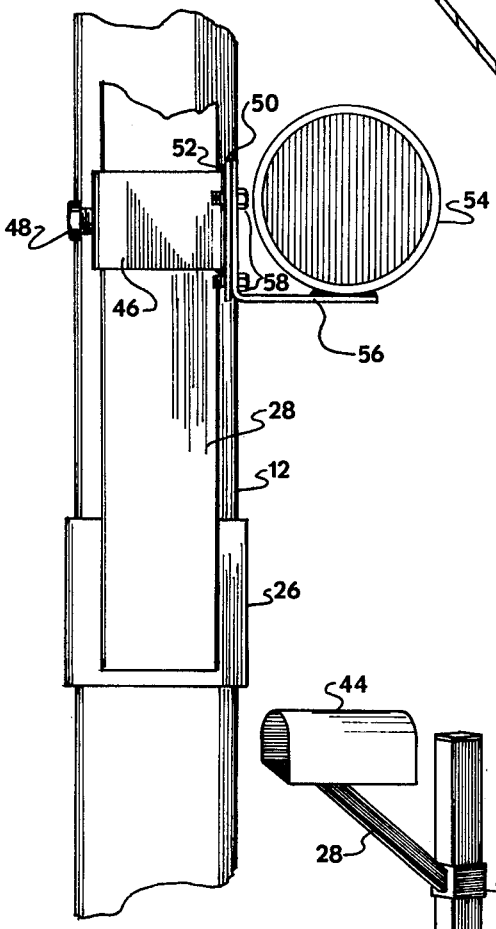
FIG. 5
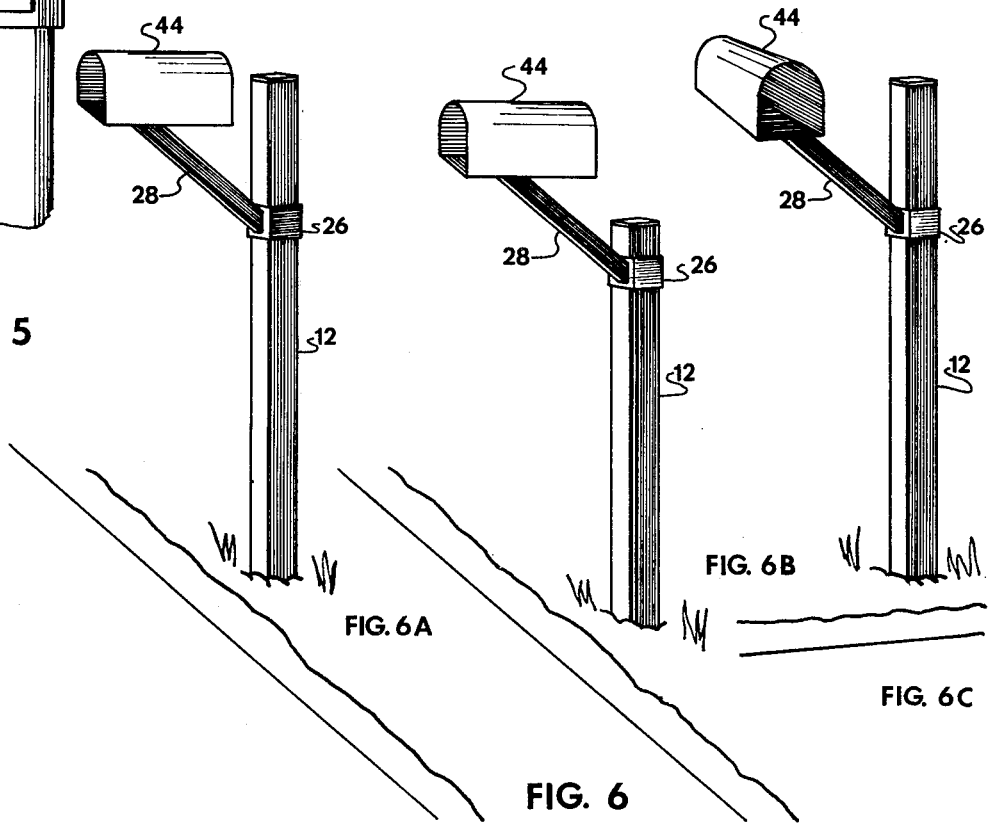
FIG. 6A
FIG. 6B
FIG. 6C
FIG. 6

ADJUSTABLE MAILBOX STANDARD

BACKGROUND OF THE INVENTION

The present invention resides in the art of support posts or standards for rural mailboxes and other such receptacles. In the rural areas of this country, it is common for persons to place mailboxes along the road or highway in front of their dwelling. Indeed, the sights of mailboxes affixed to fence posts, metal stakes, milk cans, and the like are common along country highways. However, the distance of a mailbox from the highway and the height thereof above the ground, are dictated by local postal authorities and, utilizing the aforementioned support devices, it is difficult to properly position the mailbox. Further, such support elements are generally unattractive, not adjustable or easily installed, and insecure with respect to seasonal ground swelling, vandalism, and the like.

Approaches have been taken in the prior art to provide a mailbox holder of an adjustable nature to facilitate secure and proper positioning of the mailbox along the highway. Two such approaches are shown in U.S. Pat. Nos. 3,058,710, and 3,229,940. However, it will be appreciated from a review of these patents that many drawbacks remain. In these prior art teachings, the maximum height that the mailbox may be maintained above the ground is that of the supporting post itself. Indeed, with the prior art teachings, a long post is required to provide both sufficient height above the ground and secure depth into the ground to properly maintain the mailbox. Further, in these prior art teachings, the mailbox opening is always maintained at a fixed distance from the post and in predetermined alignment therewith. Yet further, there is no simple way to adjust the box with respect to the post, nor is there an easy way for securedly inserting the post into the ground. Indeed, the prior art teaches setting the post in concrete, or inserting the same into a hole and later filling dirt in around the post to secure the same. Once so positioned, resetting the post to compensate for seasonal loosening is a major task.

While a number of posts are known from the prior art teachings of U.S. Pat. Nos. 29,316; 1,684,802; 1,754,303; and 2,351,261, there are no known teachings of hollow posts which may be easily and securedly driven into the ground. Further, the known posts are rather unattractive, expensive, and, when of such nature as to securedly engage the ground, are of substantial length and weight.

OBJECTS OF THE INVENTION

In light of the foregoing, it is an object of the instant invention to provide an adjustable mailbox standard which includes a post which may be driven into the ground for both original placement and subsequent adjustment to compensate for seasonal loosening.

It is another object of the invention to provide an adjustable mailbox standard which includes a mailbox support, selectively positioned upon a post.

Still another object of the invention is to provide an adjustable mailbox standard wherein the mailbox may be maintained above the post, the vertical positioning of the box not being limited to the extension of the post above the ground.

Yet a further object of the invention is to provide an adjustable mailbox standard wherein the lateral positioning of the mailbox with respect to the post is adjustable, providing means for properly maintaining the positioning of the mailbox notwithstanding the presence of obstructions on the ground.

An additional object of the invention is to provide an adjustable mailbox standard which includes means for attaching a receptacle for newspapers and the like.

Still another object of the invention is to provide an adjustable mailbox standard which is simple and inexpensive to construct, reliable and durable in use, and adaptable for installation in a wide variety of topographical settings.

SUMMARY OF THE INVENTION

The foregoing and other objects of the invention which will become apparent as the detailed description proceeds are achieved by a mailbox support assembly, comprising: a hollow post being pointed at a bottom end thereof for insertion into the ground; a collar mounted upon said post; a truss obliquely connected to and extending from said collar; and a support bracket connected to said truss for receiving and maintaining a mailbox at an end of said truss.

DESCRIPTION OF DRAWINGS

For a complete understanding of the objects, techniques, and structure of the invention, reference should be had to the following detailed description and accompanying drawings, wherein:

FIG. 1 is a perspective view of the mailbox standard of the invention;

FIG. 2 is a sectional view of the cap plate of the post of the invention;

FIG. 3 is an enlarged plan view of the collar fitted upon the post and having a truss connected thereto;

FIG. 4 is a sectional view of the end of the truss pivotally and adjustably connected to the support bracket;

FIG. 5 is a front plan view of a truss collar connected to the box-supporting truss, and adapted for receiving a newspaper receptacle or the like; and FIG. 6, comprising FIGS 6A–6C, shows the utility of the invention for positioning the mailbox with respect to height and distance from the roadway surface.

DETAILED DESCRIPTION OF PREFERRED EMBODIMENT

Referring now to the drawings and more particularly FIG. 1, it can be seen that the mailbox standard of the invention is designated generally by the numeral 10. The standard 10 includes a post 12, preferably of square cross-section, and cut at one end thereof on a bias as at 14 to provide a corner point 16. It will be appreciated that the post 12 is manufactured from long pieces of metal stock and that the bias cut 14 not only provides a corner point 16, but allows ends of two posts to be cut simultaneously from the common stock, with the cutting blade never passing through material greater than twice the wall thickness of the post.

As mentioned above, the post 12 is adapted for being driven into the ground for securing engagement therewith. The corner point 16 provides for a piercing of the ground, while the hollow interior 18 allows earth to drive up into the post 12 as the post is set. Hence, there is minimal disturbance of the soil, resulting in a securely set post.

To facilitate driving of the post with a sledge hammer or the like, a cap or plate 20 may be welded or otherwise affixed as at 22 to the top end of the post 12. As best shown in FIG. 2, the plate 20 is of a substantial reinforcing nature, being of quarter-inch steel stock. If desired, a wooden block may be placed over the plate 20 during the driving operation to prevent distortion or marring.

Maintained upon the post 12 is a support arm assembly 24. A collar 26, of square cross-section, is adapted to be receiving upon the post 12. A truss 28 is affixed to the collar 26 and extends oliquely therefrom. The angle at which the truss 28 extends upwardly from the collar 26 may, of course, vary. In a preferred embodiment of the invention, to facilitate manufacturing, the ends of the truss 28 are cut at 45° such that, using continuous stock, ends of two trusses 28 may be formed from the same stock during a single cutting operation. While the truss 28 may be of any suitable nature, the truss is preferably of square cross-section and of 18-gauge hollow steel construction. As shown in FIGS. 1 and 3, the truss 28 is secured to the collar 26 by means of weld joints 30, and the collar 26 is in turn secured to the post 12 by means of a setscrew or bolt 32, which may be tightened through a tapped hole in the collar 26 to make tight, securing engagement against the post 12.

As shown in FIGS. 1 and 4, a cap plate 34 is welded to an end of the truss 28. The plate 34 is tapped to receive a bolt 36 which, in turn, secures a base member 32 to the end of the truss 28. At each end of the base member 28 are adjustable fingers 40 provided with adjustment holes 41 therein. A bolt and nut arrangement 43 passes through selected holes 41 and a complementary hole in each end of the base member 38 to secure the fingers 40 thereto. The holes 41 allow adjustment of the fingers 40 to accommodate various standard sizes of mailboxes. The fingers 40 are flanged at the ends thereof and provided with holes 42 therein for allowing nut and bolt or screw engagement with the bottom side edges of a standard mailbox 44.

It will be appreciated that the end cuts of the truss 28 must be at complementary angles such that the assembly 38–43 will maintain the mailbox 44 in perpendicular relationship to the vertical post 12. The alignment of the mailbox 44 with respect to the truss 28 or the post 12 is adjustable by means of the bolt 36 passing through a hole within the base member 38 and into threaded engagement with a tapped hole in the cap plate 34. Indeed, the mailbox 44 may lie within the plane defined by the truss 28 and the post 12, or may be perpendicular thereto. In fact, the mailbox 44 may take any of numerous positions with respect to alignment with the post and truss 12,28.

Also included as part and parcel of the instant invention is a truss collar 46 adjustably maintained upon the truss 28. A bolt or setscrew 48 passes through a tapped hole in the collar 46 to make the secured engagement. A bracket 50 is welded or otherwise affixed as at 52 to the collar 46 for receiving bolts 58 passing through an L-bracket 56 which is, in turn, connected to a newspaper receptacle 54. Such newspaper receptacles are well known in the art as taught in U.S. Pat. Nos. 2,709,038, and 3,134,538. The particular nature of the bracket 56 will, of course, determine the nature of the bracket 50 and the positioning of the holes for receiving the bolts 58. Of course, the bracket 50 is welded onto the collar 46 at such an angle as to maintain the receptacle 54 in a horizontal posture.

In use, the post 12 is driven into the ground by means of a sledge hammer or the like at a point such that the opening of the mailbox 44 will be at the prescribed distance from the edge of the roadway. The post is driven into the ground until it is determined that the same is secure, the depth of such drive being dependent upon the nature of the soil. The collar 26, with the mailbox affixed to the assembly 38–43, is placed over the post 12 and lowered to a point where the box 44 is maintained at the proper elevation. At this point, the setscrew or bolt 32 is tightened into secure engagement with the side of the post 12. Such a positioning is shown in FIG. 6A.

A particular attribute of the instant invention is that the mailbox 44 may be maintained above the top of the post 12 by virtue of the oblique truss 28. Indeed, the post 12 may be driven a substantial depth before it is secure in the soil and, at such depth, adjustment of the collar 26 to properly position the height of the mailbox 44 may result in the box 44 extending above the post 12. However, such a positioning is still attractive, as evidenced by FIG. 6B, and allows for minimizing the length required for the post 12.

With reference to FIG. 6C, another attribute of the instant invention may be seen. In the event that there is a ditch, rock, or other obstruction along the road surface, such that positioning of the post as in FIGS. 6A or 6B would be prohibited, it is possible to position the post as shown in FIG. 6C with the truss 28 extending parallel to the road surface and maintaining the mailbox 44 at the end thereof. The utilization of the bolt 36 securing the base member 38 and the pivotal adjustability resulting therefrom provide such an attribute. It will be appreciated that any of numerous positionings of the post 12 with respect to the surface of the roadway are now possible with the pivotal adjustment of the mailbox 44 with respect to the plate 34 maintaining the proper relationship between the mailbox and the roadway. Again, in utilization of the invention as shown in FIG. 6C, the collar 26 is secured upon the post 12 at the proper height by means of the bolt 32.

It will be understood that should the post 12 loosen due to seasonal changes, or for any other reason, one may simply drive the post 12 slightly deeper to resecure the same and then reposition the collar 26 to maintain the box 44 at the height dictated by the local postal authorities. Consequently, there is no need for driving a new post or otherwise securing the old post after the spring thaw.

It has been found that utilizing the particular structure of the preferred embodiment, a durable and cost effective mailbox standard may be produced which, in spite of its durability, is rather lightweight and easily packaged and shipped. The mailbox standard is aesthetically pleasing while not including any unnecessary or nonfunctional structure or weight. The cap 20 prevents water and debris from falling inside the post and thus inhibits rusting and corroding, substantially extending the life of the post. The post is adaptable for use in a wide variety of terrains and is easily assembled and installed by the homeowner. The invention herein fills a void left in the art of mailbox standards from the rudimentary home-made standards to the patented ones known to applicant.

It is to be understood that the post 12 and support arm assembly 24 are considered to be novel advances in the art, both jointly and severally. The assembly 24 may be used with a post other than that disclosed herein. For example, a wooden post might be used, with the setscrew 32 being received into the post to support the collar 26. Similarly, the post 12 might be used for other than a mailbox standard, such as for supporting signs or the like.

While in accordance with the patent statutes only the best mode and preferred embodiment of the invention has been presented and described in detail, it is to be understood that the invention is not limited thereto or thereby. Consequently, for an appreciation of the true scope and breadth of the invention, reference should be had to the following claims.

What is claimed is:

1. A mailbox support assembly, comprising:

a hollow post cut at a bias to form a point at a bottom end thereof for insertion into the ground;

a first collar adjustably mounted upon said post;

a truss obliquely connected to and extending from said collar; and a support bracket connected to said truss and selectively positionable at an end thereof for receiving and maintaining a mailbox at an end of said truss, said support bracket including a base member connected to said truss and adjustable fingers at opposite ends of said base member for making secure engagement with various sizes of mailboxes.

2. The mailbox support assembly as recited in claim 1 wherein said post is capped at a top end thereof.

3. The mailbox support assembly as recited in claim 1 which further includes a second collar maintained upon said truss and including means for securing a receptacle in alignment with the mailbox.

4. In a mailbox support assembly having a post for insertion into the ground, the improvement, comprising:

a truss member;

a collar connected to said truss member at a first end thereof;

a support bracket selectively positionable upon said truss member at a second end thereof; and wherein said truss member is obliquely connected to said collar at said first end and has a cap at said second end, said support bracket being bolted to said cap, and wherein said support bracket includes a base member bolted to said cap and adjustable fingers perpendicularly connected to said base member at opposite ends thereof.

5. The improvement as recited in claim 4 which further includes a truss collar maintained upon said truss and having means thereon for securing a receptacle.

* * * * *